US009250583B1

(12) United States Patent
Himeno

(10) Patent No.: US 9,250,583 B1
(45) Date of Patent: Feb. 2, 2016

(54) FIXING DEVICE HAVING A MOVABLE HEATING SECTION FOR INCREASING CALORIFIC VALUE AND AN IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Satoshi Himeno, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/551,301

(22) Filed: Nov. 24, 2014

(51) Int. Cl.
*G03G 15/00* (2006.01)
*G03G 15/20* (2006.01)

(52) U.S. Cl.
CPC ..... *G03G 15/2053* (2013.01); *G03G 15/2082* (2013.01); *G03G 15/2042* (2013.01)

(58) Field of Classification Search
CPC ..... G03G 15/2078; G03G 15/2082; G03G 15/2042
USPC ..... 399/329, 334
See application file for complete search history.

(56) References Cited

U.S. PATENT DOCUMENTS

| | | | | |
|---|---|---|---|---|
| 8,855,539 | B2 * | 10/2014 | Mita et al. | 399/329 |
| 2006/0245797 | A1 * | 11/2006 | Suzuki | 399/328 |
| 2008/0019742 | A1 * | 1/2008 | Ohno | 399/333 |
| 2009/0297197 | A1 * | 12/2009 | Hase | 399/69 |
| 2012/0177419 | A1 * | 7/2012 | Kikuchi | 399/329 |
| 2012/0207502 | A1 * | 8/2012 | Seo | 399/69 |
| 2013/0022381 | A1 * | 1/2013 | Kawamoto et al. | 399/328 |
| 2013/0084112 | A1 * | 4/2013 | Sasaki | 399/329 |

* cited by examiner

*Primary Examiner* — Clayton E Laballe
*Assistant Examiner* — Trevor J Bervik
(74) *Attorney, Agent, or Firm* — Amin, Turocy & Watson, LLP

(57) ABSTRACT

In accordance with one embodiment, a fixing device comprises an induction current generating section, a heating section and an auxiliary heating section. The induction current generating section generates induction current. The heating section generates heat through the induction current. The auxiliary heating section increases the calorific value of the heating section based on the induction current as it is moved closer to the heating section, but does not generate heat itself through the induction current.

6 Claims, 11 Drawing Sheets

FIXING DEVICE HAVING A MOVABLE HEATING SECTION FOR INCREASING CALORIFIC VALUE AND AN IMAGE FORMING APPARATUS

FIELD

Embodiments described herein relate generally to a fixing device and an image forming apparatus.

BACKGROUND

Conventionally, there is a multi function peripheral (hereinafter referred to as an "MFP") and an image forming apparatus such as a printer and the like. The image forming apparatus is provided with a fixing device. The fixing device heats a fixing belt through an electromagnetic induction heating method (hereinafter referred to as an "IH method") to fix a toner image on an image receiving medium through the heat of the fixing belt. The fixing belt has a heating layer which generates heat through induction current. The fixing device reduces the heat capacity of the fixing belt to reduce the warming up time and the like. The fixing device includes a magnetic shunt alloy layer for compensating the deficiency of the calorific value of the fixing belt. The magnetic characteristic of the magnetic shunt alloy layer varies according to the temperature. The magnetic shunt alloy layer is transformed from a ferromagnetic body into a paramagnetic body at a curie point. The magnetic shunt alloy layer generates heat itself. The magnetic shunt alloy layer loses its magnetism and does not generate heat any more at the curie point. The calorific value of the fixing belt may be excessively increased due to the heat generated by the magnetic shunt alloy layer itself, which may lead to a problem that the heating efficiency of the fixing belt cannot be improved.

DETAILED DESCRIPTION

Figure 1:
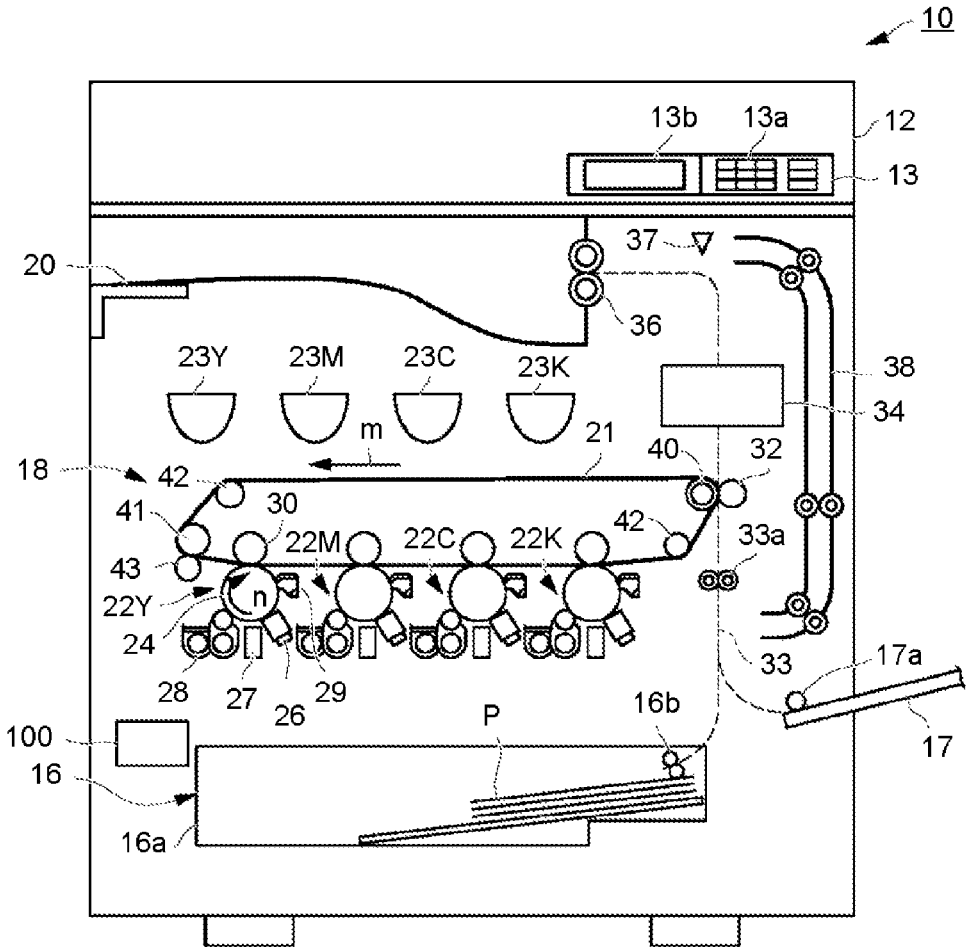
FIG. 1 is a side view of an image forming apparatus according to a first embodiment.

In accordance with one embodiment, a fixing device comprises an induction current generating section, a heating section and an auxiliary heating section. The induction current generating section generates induction current. The heating section generates heat through the induction current. The auxiliary heating section increases the calorific value of the heating section based on the induction current as it is moved closer to the heating section. The auxiliary heating section does not generate heat itself through the induction current.

Hereinafter, an image forming apparatus 10 according to the first embodiment is described with reference to the accompanying drawings. In addition, the same components are indicated by the same reference numerals in the drawings.

FIG. 1 is a side view of the image forming apparatus 10 according to the first embodiment. Hereinafter, an MFP 10 is exemplified as one example of the image forming apparatus 10.

As shown in FIG. 1, the MFP 10 includes a scanner 12, a control panel 13 and a printer section 18. The MFP 10 includes a CPU 100 for controlling the whole system of the scanner 12, the control panel 13 and the printer section 18. The printer section 18 is controlled by a main body control section 101 (refer to FIG. 2). The main body control section 101 operates according to a command of the CPU 100.

The scanner 12 reads a document image for the image formation by the printer section 18. The control panel 13 includes input keys 13*a* and a display section 13*b*. For example, the input keys 13*a* receive an input from a user. For example, the display section 13*b* is a touch panel type display. The display section 13*b* receives an input from the user and displays information to the user.

The printer section 18 includes a paper feed cassette section 16, a paper feed tray 17 and a paper discharge section 20. The paper feed cassette section 16 includes a paper feed cassette 16*a* and a pickup roller 16*b*. The paper feed cassette 16*a* stores a sheet P serving as an image receiving medium. The pickup roller 16*b* picks up the sheet P from the paper feed cassette 16*a*.

The paper feed cassette 16*a* feeds a sheet P. The paper feed tray 17 feeds a sheet P through a pickup roller 17*a*.

The printer section 18 includes an intermediate transfer belt 21. The printer section 18 supports the intermediate transfer belt 21 with a backup roller 40, a driven roller 41 and a tension roller 42. The backup roller 40 includes a driving section (not shown). The printer section 18 rotates the intermediate transfer belt 21 in a direction indicated by an arrow m.

The printer section 18 includes four image forming stations 22Y, 22M, 22C and 22K, each of which forms a Y (yellow), M (magenta), C (cyan) and K (black) image, respectively. The image forming stations 22Y, 22M, 22C and 22K are arranged side by side below the intermediate transfer belt 21 along the rotation direction of the intermediate transfer belt 21.

The printer section 18 includes a cartridge 23Y, 23M, 23C and 23K above each of the image forming stations 22Y, 22M, 22C and 22K. The cartridges 23Y, 23M, 23C and 23K stores Y (yellow), M (magenta), C (cyan) and K (black) toner for replenishment, respectively.

Hereinafter, the Y (yellow) image forming station 22Y within the image forming stations 22Y, 22M, 22C and 22K is exemplified. In addition, the image forming stations 22M, 22C and 22K are structurally identical to the image forming station 22Y, and therefore, the detailed description thereof is not repeated.

The image forming station 22Y includes an electrostatic charger 26, an exposure scanning head 27, a developing device 28 and a photoconductor cleaner 29. The electrostatic charger 26, the exposure scanning head 27, the developing device 28 and the photoconductor cleaner 29 are arranged around a photoconductive drum 24 which rotates in a direction indicated by an arrow n.

The image forming station 22Y includes a primary transfer roller 30 opposite to the photoconductive drum 24 across the intermediate transfer belt 21.

The image forming station 22Y exposes the photoconductive drum 24 with the exposure scanning head 27 after charging the photoconductive drum 24 with the electrostatic charger 26. In this way, the image forming station 22Y forms an electrostatic latent image on the photoconductive drum 24. The developing device 28 develops the electrostatic latent image on the photoconductive drum 24 with the two-component developing agent including the toner and carrier.

The primary transfer roller 30 primarily transfers the toner image formed on the photoconductive drum 24 to the intermediate transfer belt 21. The image forming stations 22Y, 22M, 22C and 22K form a color toner image on the intermediate transfer belt 21 through the primary transfer roller 30. The color toner image is formed by overlapping the Y (yellow), M (magenta), C (cyan) and K (black) toner images in sequence. The photoconductor cleaner 29 removes the toner left on the photoconductive drum 24 after the primary transfer.

The printer section 18 further includes a secondary transfer roller 32 opposite to the backup roller 40 across the intermediate transfer belt 21. The secondary transfer roller 32 secondarily transfers the color toner images on the intermediate transfer belt 21 to the sheet P collectively. The sheet P is fed from the paper feed cassette section 16 or the paper feeding tray 17 along a conveyance path 33.

The printer section 18 includes a belt cleaner 43 opposite to the driven roller 41 across the intermediate transfer belt 21. The belt cleaner 43 removes the toner left on the intermediate transfer belt 21 after the secondary transfer. In addition, the image forming section includes the intermediate transfer belt 21, the four image forming stations 22Y, 22M, 22C and 22K, and the secondary transfer roller 32.

The printer section 18 includes a register roller 33*a*, a fixing device 34 and a paper discharge roller 36 along the conveyance path 33. The printer section 18 includes a branch section 37 and a reversal conveyance section 38 at the downstream side of the fixing device 34. The branch section 37 guides the sheet P subjected to fixing processing to the paper discharge section 20 or the reversal conveyance section 38. In a case of duplex printing, the reversal conveyance section 38 reversely conveys the sheet P guided by the branch section 37 to the direction of the register roller 33*a*. The MFP 10 forms a fixed toner image on the sheet P with the printer section 18 and then discharges the sheet P to the paper discharge section 20.

In addition, the MFP 10 is not limited to the tandem development type, and the number of the developing devices 28 is not limited. Further, the MFP 10 may directly transfer the toner image to the sheet P from the photoconductive drum 24. Further, the printer section 18 may form an image with non-decolorable toner and decolorable toner.

Hereinafter, the fixing device 34 is described in detail.

Figure 2:
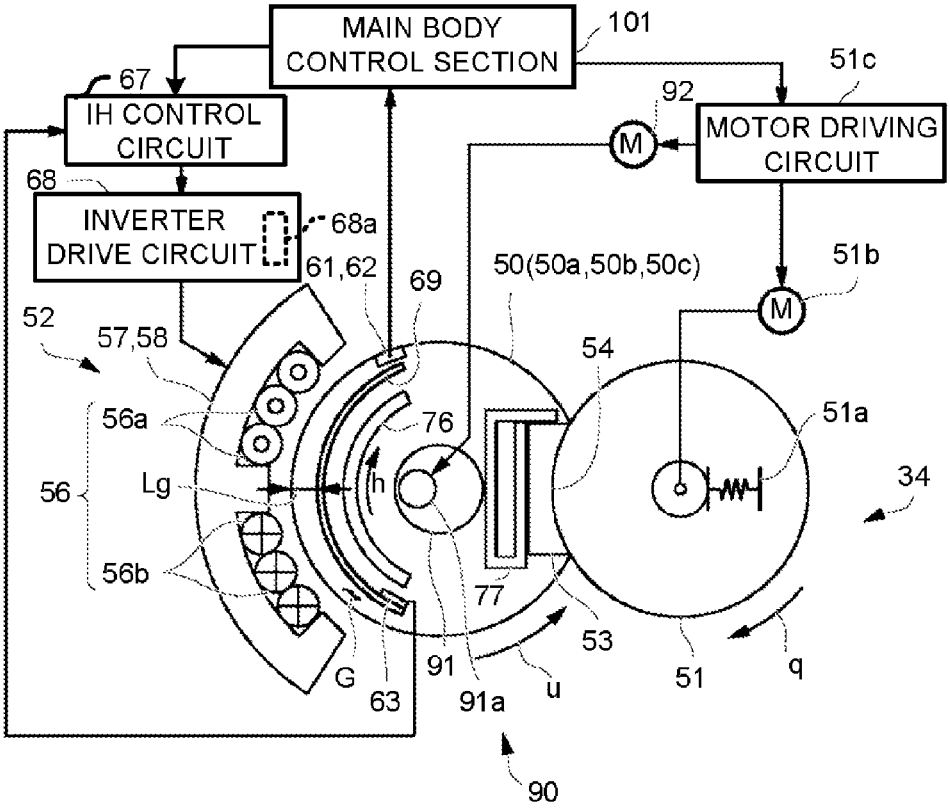
FIG. 2 is a side view of a fixing device including a control block of an IH coil unit according to the first embodiment.

FIG. 2 is a side view of the fixing device 34 including the control block of an IH coil unit 52 according to the first embodiment.

As shown in FIG. 2, the fixing device 34 includes a fixing belt 50, a pressing roller 51, the electromagnetic induction heating coil unit 52 and a driving section 90. The electromagnetic induction heating coil unit 52 is an induction current generation section. Hereinafter, the electromagnetic induction heating coil unit is referred to as the "IH coil unit".

A nip pad 53, an auxiliary heating plate 69 serving as an auxiliary heating section, a shield 76 serving as a support member and an eccentric cam 91 are arranged inside the fixing belt 50. Further, a center thermistor 61, an edge thermistor 62, a thermostat 63 and a stay 77 are arranged inside the fixing belt 50. The shield 76 supports the auxiliary heating plate 69. The stay 77 supports the nip pad 53.

The fixing belt 50 is driven, through the rotation of the pressing roller 51, to rotate in a direction indicated by an arrow u, alternatively, the fixing belt 50 is rotated in a direction indicated by an arrow u independently. In a case in which the fixing belt 50 and the pressing roller 51 are rotated independently, an one-way clutch may be arranged so that no speed difference between the fixing belt 50 and the pressing roller 51 occurs.

The fixing belt 50 is a cylindrical endless belt. The fixing belt 50 is formed by laminating a heating layer 50*a* and a release layer 50*c* over a base layer 50*b* in sequence. In addition, the fixing belt 50 is not limited to a layer structure as long as the fixing belt 50 includes the heating layer 50*a*.

For example, the base layer 50*b* is formed by polyimide (PI) resin. For example, the heating layer 50*a* is formed by nonmagnetic metal such as copper (Cu) and the like. For example, the release layer 50*c* is formed by fluororesin such as copolymer (PFA) resin of tetrafluoroethylene and perfluoro alkyl vinyl ether.

The heating layer 50*a* is thinned to reduce the heat capacity so that the fixing belt 50 can carry out warming up rapidly. The fixing belt 50 with low heat capacity can reduce the time required for the warming up operation and save the consumption of power.

For example, the fixing belt 50 sets the thickness of the copper layer of the heating layer 50*a* to 10 μm to reduce the heat capacity thereof. For example, the heating layer 50*a* of the fixing belt 50 is provided with a protective layer such as a nickel (Ni) layer and the like. The protective layer such as a nickel layer suppresses the oxidation of the copper layer and meanwhile improves the mechanical strength of the copper layer.

For example, the heating layer 50*a* is formed by carrying out electroless nickel plating and copper plating on the base layer 50*b* formed by the polyimide resin. The adhesion strength between the base layer 50*b* and the heating layer 50*a* and the mechanical strength of the heating layer 50*a* can be improved through the electroless nickel plating.

The surface of the base layer 50*b* may be roughened through a sandblasting processing or a chemical etching processing. In this way, the adhesion strength between the base layer 50*b* and the nickel plating of the heating layer 50*a* can be further improved mechanically.

Further, metal such as titanium (Ti) and the like may be dispersed on the polyimide resin forming the base layer 50*b*. In this way, the adhesion strength between the base layer 50*b* and the nickel plating of the heating layer 50*a* can be improved.

For example, the heating layer 50*a* is formed by nickel, iron (Fe), stainless steel, aluminum (Al), silver (Ag) and the like. The heating layer 50*a* may be an alloy formed with two or more categories of metals; alternatively, the heating layer 50*a* may be formed by overlapping two or more categories of metals in a layer shape.

The heating layer 50*a* generates eddy current through the magnetic flux generated by the IH coil unit 52. The heating layer 50*a* generates joule heat through the resistivity of the heating layer 50*a* and the eddy current to heat the fixing belt 50.

Figure 3:
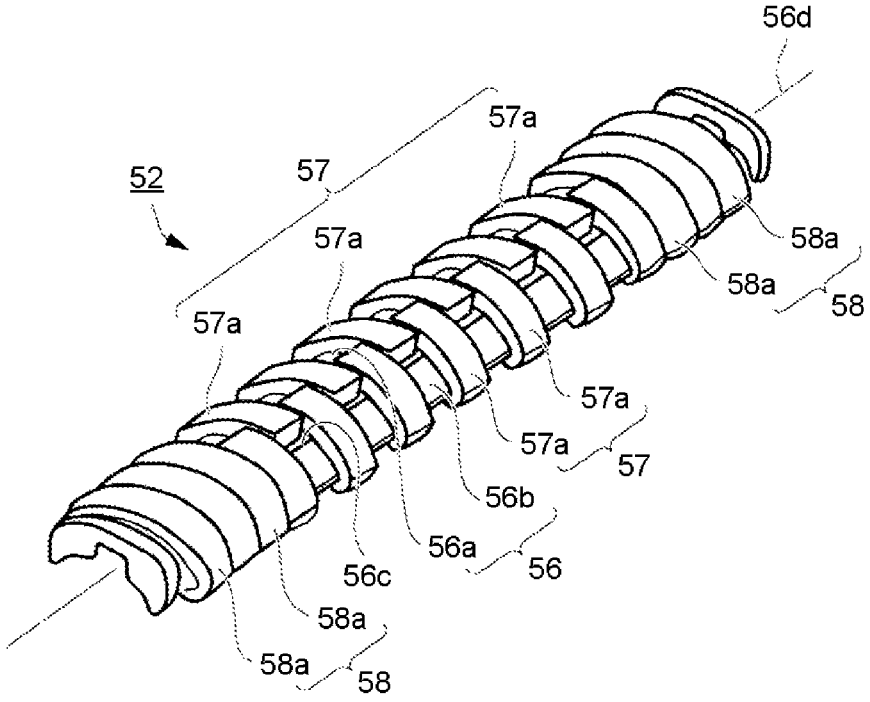
FIG. 3 is a perspective view illustrating of the IH coil unit according to the first embodiment.

FIG. 3 is a perspective view illustrating the IH coil unit 52 according to the first embodiment.

As shown in FIG. 3, the IH coil unit 52 includes coils 56, a first core 57 and a second core 58.

The coils 56 generate the magnetic flux. The coils 56 face the fixing belt 50. The longitudinal direction of the coils 56 corresponds to the width direction (hereinafter referred to as a "belt width direction") of the fixing belt 50.

The first core 57 and the second core 58 cover the side (hereinafter referred to as "back side") of the coils 56 opposite to the fixing belt 50. The first core 57 and the second core 58 prevent the magnetic flux generated by the coil 56 from being leaked from the back side, and concentrate the magnetic flux generated by the coil 56 to the fixing belt 50.

The first core 57 includes a plurality of single wing parts 57*a* which are alternately arranged in a staggered manner by taking a center line 56*d* along the longitudinal direction of the coil 56 as an axis of symmetry. The second core 58 is arranged at each of the both sides of the first core 57. The second core 58 includes a plurality of two wings parts 58*a* straddling both wings of the coil 56. For example, the single wing part 57*a* and the two wings part 58*a* are formed with magnetic materials such as nickel-zinc alloy (Ni—Zn), manganese-nickel alloy (Mn—Ni) and the like.

The first core 57 alternately regulates, with the plurality of single wing parts 57*a*, the magnetic flux generated by the coil 56 for each single wing of the coil 56 with the center line 56*d* taken as an axis of symmetry. The first core 57 concentrates the magnetic flux generated by the coil 56 to the fixing belt 50 with the plurality of single wing parts 57*a*.

The second core 58 regulates, with the plurality of two wings parts 58*a*, the magnetic flux generated by the coil 56 for the two wings of the coil 56 at the two sides of the first core 57. The second core 58 concentrates the magnetic flux generated by the coil 56 to the fixing belt 50 with the plurality of two wings parts 58*a*. The magnetic flux concentration force of the second core 58 is stronger than that of the first core 57.

As shown in FIG. 2, the IH coil unit 52 generates induction current when the fixing belt 50 is rotated in a direction indicated by an arrow u. Through the induction current, the heating layer 50*a* of the fixing belt 50 facing the IH coil unit 52 generates heat.

For example, the coil 56 may be a litz wire which is formed by bundling a plurality of copper wire materials covered by heat-resistant polyamide-imide serving as an insulation material. The coil 56 is formed by circulating a conductive coil. As shown in FIG. 3, the coil 56 includes first wings 56*a* and second wings 56*b*. The first wings 56*a* are arranged at one side of the center line 56*d*, while the second wings 56*b* are arranged at the other side of the center line 56*d*. A window portion 56*c* is formed at the center in the longitudinal direction of the coil 56, that is, the space between the first wings 56*a* and the second wings 56*b*.

As shown in FIG. 2, the coil 56 generates the magnetic flux through the application of high-frequency current from an inverter drive circuit 68. For example, the inverter drive circuit 68 includes an IGBT (Insulated Gate Bipolar Transistor) element 68*a*.

The auxiliary heating plate 69 is formed into an arc shape along the inner peripheral surface of the fixing belt 50 at a distance of a gap G from the inner peripheral surface of the fixing belt 50. The closer the auxiliary heating plate 69 is to the fixing belt 50, the more the calorific value of the fixing belt 50 based on the induction current generated by the IH coil unit 52 can be increased. The auxiliary heating plate 69 does not generate heat itself through the induction current generated by the IH coil unit 52.

For example, the auxiliary heating plate 69 may be formed by the following magnetic material (ferrite). The magnetic material (ferrite) promotes the heating of the fixing belt 50 through the magnetic flux based on the induction current and does not generate heat itself even if it is bathed in the magnetic flux based on the induction current.

The auxiliary heating plate 69 assists in the heating of the heating layer 50*a* of the fixing belt 50 based on the IH coil unit 52. The auxiliary heating plate 69 assists in the heating of the fixing belt 50.

For example, the auxiliary heating plate 69 is formed by Mn—Zn ferrite and the like. The Mn—Zn ferrite contains iron oxide ($Fe_2O_3$), zinc oxide (ZnO) and manganese oxide (MnO).

Figure 4:
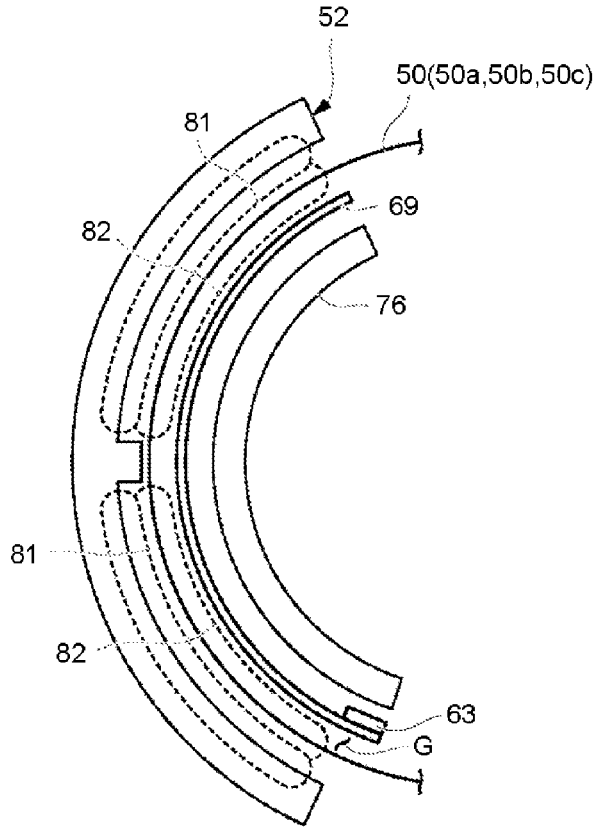
FIG. 4 is an illustration diagram of a magnetic path to a fixing belt and an auxiliary heating plate based on magnetic flux of the IH coil unit according to the first embodiment.

FIG. 4 is an illustration diagram of a magnetic path to the fixing belt 50 and the auxiliary heating plate 69 based on the magnetic flux of the IH coil unit 52 according to the first embodiment. For the sake of the convenience of description, the coil 56 and the like are not shown in FIG. 4.

As shown in FIG. 4, the magnetic flux generated by the IH coil unit 52 is inducted to the heating layer 50*a* of the fixing belt 50 to form a first magnetic path 81. The magnetic flux generated by the IH coil unit 52 is inducted to the auxiliary heating plate 69 to form a second magnetic path 82.

The auxiliary heating plate 69 assists in the heating of the heating layer 50*a* of the fixing belt 50 during the warming up process of the fixing belt 50 to accelerate the warming up. The auxiliary heating plate 69 assists in the heating of the heating layer 50*a* of the fixing belt 50 during the printing process to maintain the fixing temperature of the fixing belt 50.

For example, as shown in FIG. 2, the shield 76 is formed by a nonmagnetic material such as aluminum, copper and the like. The shield 76 shields the magnetic flux from the IH coil unit 52, and prevents the stay 77, the nip pad 53 and the like arranged inside the fixing belt 50 from being affected by the magnetic flux generated by the IH coil unit 52.

The nip pad 53 presses the inner peripheral surface of the fixing belt 50 against the pressing roller 51 to form a nip 54 between the fixing belt 50 and the pressing roller 51. For example, the nip pad 53 is formed by heat-resistant polyphenylene sulfide resin (PPS), liquid crystal polymer (LCP), phenol resin (PF) and the like.

For example, a sheet having good sliding property and excellent abrasion resistance or a release layer formed by fluororesin is arranged between the nip pad 53 and the fixing belt 50. With such a release layer and the like, the frictional resistance between the fixing belt 50 and the nip pad 53 is reduced.

For example, the pressing roller 51 includes heat-resistant silicon sponge, or a silicon rubber layer and the like around a core bar. For example, a release layer formed by fluorocarbon resin such as PFA resin is arranged on the surface of the pressing roller 51. The pressing roller 51 presses against the nip pad 53 through a pressing mechanism 51*a*. The pressing roller 51 is rotated in a direction indicated by an arrow q by a motor 51*b*. The motor 51*b* is driven by a motor driving circuit 51*c* controlled by the main body control section 101.

A center thermistor 61 and an edge thermistor 62 detect the temperature of the fixing belt 50 and input the detected temperature of the fixing belt 50 to the main body control section 101. The center thermistor 61 is arranged at the center of the fixing belt in the belt width direction.

The edge thermistor 62 is arranged at a position more outer than the IH coil unit 52 in the belt width direction. The edge thermistor 62 detects, with high precision, the temperature of the outer side in the belt width direction of the fixing belt 50 without being affected by the IH coil unit 52.

The main body control section 101 controls an IH control circuit 67 according to the detection results of the center thermistor 61 and the edge thermistor 62. The IH control circuit 67 controls the magnitude of the high-frequency current output by the inverter drive circuit 68 under the control of the main body control section 101. The fixing belt 50 maintains various control temperature ranges according to the output of the inverter drive circuit 68.

The thermostat 63 functions as a safety device of the fixing device 34. The thermostat 63 operates when the fixing belt 50 is abnormally heated and the temperature of the fixing belt 50 rises to a given cut-off threshold value. The current output to the IH coil unit 52 is cut off through the operation of the thermostat 63. When the current output to the IH coil unit 52 is cut off, the MFP 10 is no longer driven, and in this way, the abnormal heating of the fixing device 34 is suppressed.

The driving section 90 includes the eccentric cam 91 and a cam motor 92. The eccentric cam 91 includes an axis 91*a* parallel to the belt width direction. The cam motor 92 is driven by the motor driving circuit 51*c*. The eccentric cam 91 is rotated by the cam motor 92 in a direction indicated by an arrow h around the axis 91*a*.

The motor driving circuit 51*c* controls the cam motor 92 based on the detection result of the edge thermistor 62. For example, the temperature before the non-paper passing area AR2 (refer to FIG. 5) of the fixing belt 50 is heated excessively is set as a given temperature threshold value. When the detection result of the edge thermistor 62 reaches the given temperature threshold value, the motor driving circuit 51*c* controls the cam motor 92 to adjust an interval Lg (refer to FIG. 6).

Figure 5:
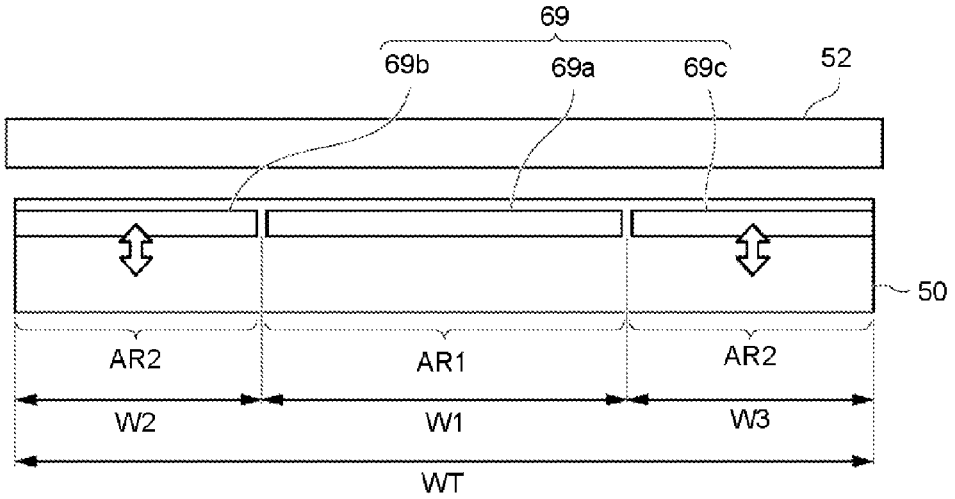
FIG. 5 is an illustration diagram illustrating the arrangement of division portions of the auxiliary heating plate, the fixing belt and the IH coil unit according to the first embodiment.

FIG. 5 is an illustration diagram illustrating the arrangement of division portions 69*a*, 69*b* and 69*c* of the auxiliary heating plate 69, the fixing belt 50 and the IH coil unit 52 according to the first embodiment.

As shown in FIG. 5, the auxiliary heating plate 69 includes three division portions 69*a*, 69*b* and 69*c* divided in the belt width direction. In addition, the auxiliary heating plate 69 may include two, or four or more than four division portions divided in the belt width direction.

Hereinafter, the division portion 69*a* that is positioned at the center in the belt width direction within the three division portions 69*a*, 69*b* and 69*c* is referred to as a "center portion". The division portion 69*b* positioned at a first end in the belt width direction is referred to as a "first side portion", and the division portion 69*c* positioned at a second end in the belt width direction is referred to as a "second side portion".

The width WT (hereinafter referred to as a "belt width") of the fixing belt 50 is longer than the shorter side width of the A3-sized paper. The width W1 (hereinafter referred to as a "center width") of the center portion 69*a* is longer than the shorter side width (hereinafter referred to as a "A4R width") of the A4-sized paper. The width W2 (hereinafter referred to as a "first side width") of the first side portion 69*b* is equal to the width W3 (hereinafter referred to as a "second side width") of the second side portion 69*c*. Further, the center width W1 may be equal to the A4R width. In addition, the first side width W2 and the second side width W3 may be different from each other.

The center portion 69*a* is held at a certain position without being moved by the driving section 90. The driving section 90 collectively moves the first side portion 69*b* and the second side portion 69*c*. The driving section 90 moves the first side portion 69*b* and the second side portion 69*c* closer to or away from the fixing belt 50.

Figure 6:
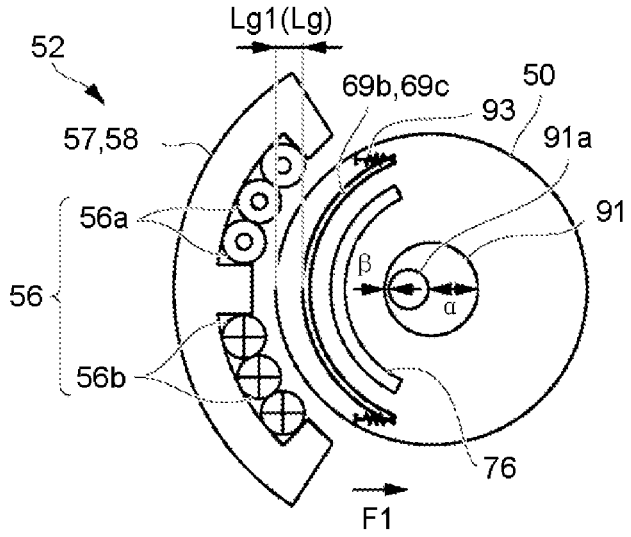
FIG. 6 is a side view illustrating a state in which side portions of the auxiliary heating plate are separated from the inner peripheral surface of the fixing belt according to the first embodiment.

FIG. 6 is a side view illustrating a state in which the side portions 69*b* and 69*c* of the auxiliary heating plate 69 are separated from the inner peripheral surface of the fixing belt 50 according to the first embodiment.

Figure 7:
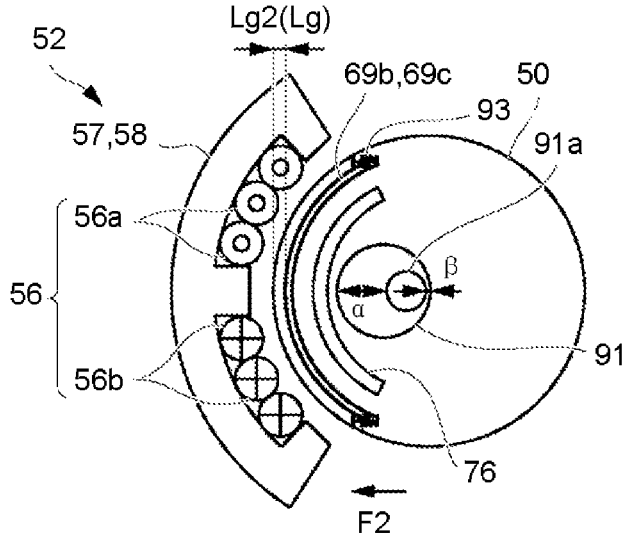
FIG. 7 is a side view illustrating a state in which the side portions of the auxiliary heating plate are moved closer to the inner peripheral surface of the fixing belt according to the first embodiment.

FIG. 7 is a side view illustrating a state in which the side portions 69*b* and 69*c* of the auxiliary heating plate 69 are moved closer to the inner peripheral surface of the fixing belt 50 according to the first embodiment.

Figure 8:
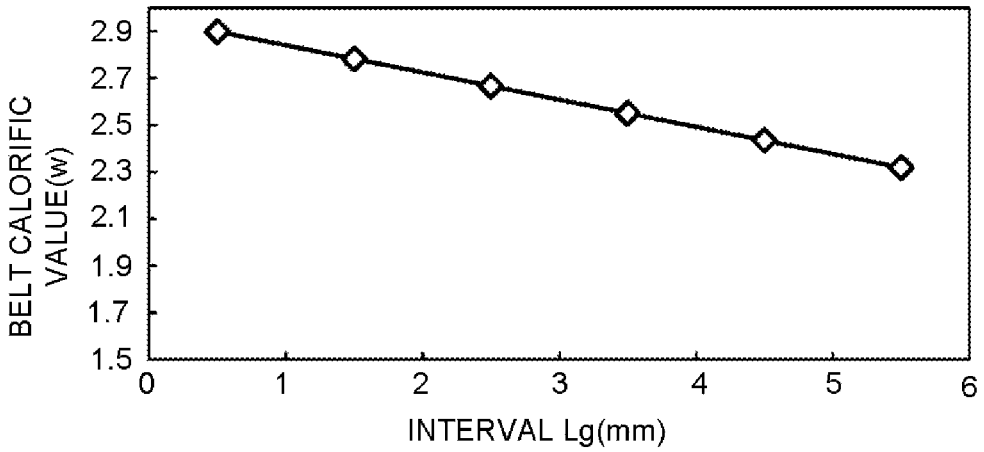
FIG. 8 is a graph illustrating the relation between the calorific value of the fixing belt and an interval between the inner peripheral surface of the fixing belt and the side portions of the auxiliary heating plate according to the first embodiment.

FIG. 8 is a graph illustrating the relation between the calorific value of the fixing belt 50 and the interval Lg between the inner peripheral surface of the fixing belt 50 and the side portions 69*b* and 69*c* of the auxiliary heating plate 69 according to the first embodiment. In FIG. 8, the abscissa indicates the interval Lg (hereinafter referred to as "interval") between the inner peripheral surface of the fixing belt 50 and the side portions 69*b* and 69*c* of the auxiliary heating plate 69. The ordinate indicates the calorific value (hereinafter referred to as a "belt calorific value") of the fixing belt 50.

As shown in FIG. 6 and FIG. 7, the driving section 90 moves the eccentric cam 91 to adjust the interval Lg. The part of the shield 76 facing the side portions 69*b* and 69*c* of the auxiliary heating plate 69 is moved together with the side portions 69*b* and 69*c* through the connected with the eccentric cam 91.

In addition, the part facing the side portions 69*b* and 69*c* of the auxiliary heating plate 69 may be moved together with the side portions 69*b* and 69*c* through the connected with the eccentric cam 91. The eccentric cam 91 may be connected directly with the part facing the side portions 69*b* and 69*c* of the auxiliary heating plate 69, or connected through the shield 76 and the like. The driving section 90 may adjust the interval Lg through a piston cylinder mechanism.

In a case of passing the paper having a width equal to or shorter than the A4R width (hereinafter referred to as "a case of passing small-sized paper") through the nip, the interval Lg is relatively increased. On the other hand, in a case of passing the A3-sized paper (hereinafter referred to as "a case of passing large-sized paper") through the nip, the interval Lg is relatively decreased.

Hereinafter, a state of passing small-sized paper is described with reference to FIG. 6.

As shown in FIG. 6, the side portions 69*b* and 69*c* of the auxiliary heating plate 69 are energized in a direction indicated by an arrow F1 through the elastic force of an elastic member 93 such as a spring and the like. The eccentric cam 91 stops at a position where a short side β abuts against the shield 76. The side portions 69*b* and 69*c* of the auxiliary heating plate 69 are moved, through the elastic force of the elastic member 93, to a position which is at a distance of a first interval Lg1 from the inner peripheral surface of the fixing belt 50.

When the side portions 69*b* and 69*c* are moved far away from the inner peripheral surface of the fixing belt 50, the second magnetic path 82 (refer to FIG. 4) can hardly be formed in the side portions 69*b* and 69*c*. In a case of passing small-sized paper, the magnetic flux across the fixing belt 50 is weakened compared with a case of passing large-sized paper, as a result, the eddy current is weakened, thus, the belt calorific value is reduced.

Hereinafter, a state of passing large-sized paper is described with reference to FIG. 7.

As shown in FIG. 7, the eccentric cam 91 moves the side portions 69*b* and 69*c* of the auxiliary heating plate 69 in a direction indicated by an arrow F2 against the elastic force of the elastic member 93. The eccentric cam 91 stops at a position where a long side α abuts against the shield 76. The side portions 69*b* and 69*c* of the auxiliary heating plate 69 are moved closer to the inner peripheral surface of the fixing belt 50 against the elastic force of the elastic member 93. The side portions 69*b* and 69*c* of the auxiliary heating plate 69 are moved to a position which is at a distance of a second interval Lg2 smaller than the first interval Lg1 from the inner peripheral surface of the fixing belt 50.

When the side portions 69*b* and 69*c* are close to the inner peripheral surface of the fixing belt 50, the second magnetic path 82 (refer to FIG. 4) is formed in the side portions 69*b* and 69*c*. In a case of passing large-sized paper, the magnetic flux across the fixing belt 50 becomes stronger compared with a case of passing small-sized paper, as a result, the eddy current becomes stronger, thus, the belt calorific value is increased.

In addition, the time taken to switch from the case of passing large-sized paper to the case of passing small-sized paper may be adjusted by adjusting the rotation speed of the cam motor 92.

Hereinafter, the relation between the interval Lg and the belt calorific value is described with reference to FIG. 8.

As shown in FIG. 8, the interval Lg and the belt calorific value are in such a proportional relation that the belt calorific value is decreased as the interval Lg is increased. For example, when the interval Lg is 0.5 mm, the belt calorific value is 2.9 W; while when the interval Lg is increased to 5.5 mm, the belt calorific value is decreased to 2.3 W. The belt calorific value is decreased by 0.12 W as the interval Lg is increased by 1 mm.

Incidentally, the heat capacity of the fixing belt 50 is decreased to shorten the warming up time and the like. With the heat directly generated by the fixing belt 50 through the magnetic flux of the IH coil unit 52 and the assistance in heating from the auxiliary heating plate 69, the fixing belt 50 can achieve sufficient heat for the fixation of the sheet P. The area of the fixing belt 50 is divided, according to the size of the sheet P, into an area through which the sheet P passes and an area through which the sheet P does not pass. In the following description, the area through which the sheet P passes is referred to as a "paper passing area" and the area through which the sheet P does not pass is referred to as a "non-paper passing area".

In a case of passing small-sized paper to carry out the fixing operation continuously, the temperature in the paper passing area AR1 of the fixing belt 50 is decreased while the temperature in the non-paper passing area AR2 is increased.

The driving section 90 moves the side portions 69*b* and 69*c* of the auxiliary heating plate 69 away from the inner peripheral surface of the fixing belt 50 in a case of passing small-sized paper. In this way, the side portions 69*b* and 69*c* can hardly assist in the heating of the non-paper passing area AR2. As a result, it is possible to prevent that the temperature of the non-paper passing area AR2 of the fixing belt 50 becomes higher than the temperature of the fixing belt 50.

On the other hand, the driving section 90 moves the side portions 69*b* and 69*c* of the auxiliary heating plate 69 closer to the inner peripheral surface of the fixing belt 50 in a case of passing large-sized paper. In this way, the auxiliary heating plate 69 can assist in the heating of the entire fixing belt 50 in a case of passing large-sized paper. As a result, the heating of the fixing belt 50 is equalized.

Hereinafter, a control system 110 mainly for the control of the IH coil unit 52 which enables the fixing belt 50 to generate heat is described in detail with reference to FIG. 9.

Figure 9:
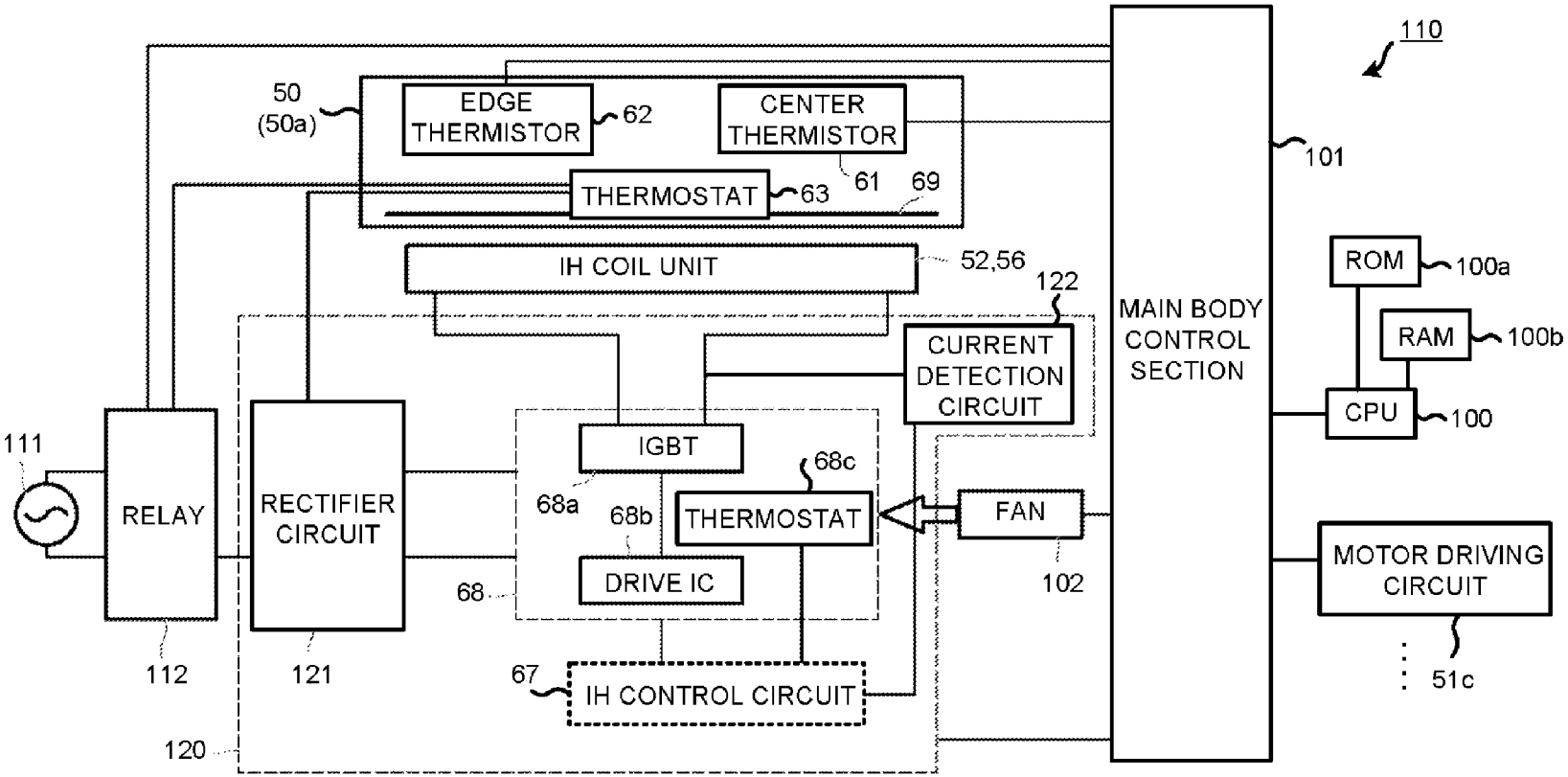
FIG. 9 is a block diagram illustrating a control system mainly for the control of the IH coil unit according to the first embodiment.

FIG. 9 is a block diagram illustrating the control system mainly for the control of the IH coil unit 52 according to the first embodiment.

As shown in FIG. 9, the control system 110 includes a CPU 100, a read only memory (ROM) 100*a*, a random access memory (RAM) 100*b*, the main body control section 101, an IH circuit 120 and the motor driving circuit 51*c*.

The CPU 100 controls the whole system. The main body control section 101 receives a command from the CPU 100 to control the printer section 18 (refer to FIG. 1).

The main body control section 101 supplies power for the IH coil unit 52 through the IH circuit 120. The IH circuit 120 includes a rectifier circuit 121, the IH control circuit 67, the inverter drive circuit 68 and a current detection circuit 122.

The IH circuit 120 rectifies, with the rectifier circuit 121, the current input from an AC power supply 111 through a relay 112 and supplies the current to the inverter drive circuit 68.

The relay 112 cuts off the current from the AC power supply 111 when the thermostat 63 is cut off. The inverter drive circuit 68 includes a drive IC 68*b* of an IGBT element 68*a* and a thermistor 68*c*. The thermistor 68*c* detects the temperature of the IGBT element 68*a*. In a case in which the thermistor 68*c* detects the temperature rise of the IGBT element 68*a*, the main body control section 101 drives a fan 102 to cool the IGBT element 68*a* down.

The IH control circuit 67 controls the drive IC 68*b* according to the detection results of the center thermistor 61 and the edge thermistor 62. The IH control circuit 67 controls the drive IC 68*b* to control the output of the IGBT element 68*a*. The current detection circuit 122 sends the detection result of the output of the IGBT element 68*a* to the IH control circuit 67. The IH control circuit 67 controls the drive IC 68*b* according to the detection result of the current detection circuit 122 so that the power supplied to the coil 56 is constant Hereinafter, the operation of the fixing device 34 in the warming up process is described.

As shown in FIG. 2, in the warming up process, the fixing device 34 rotates the pressing roller 51 in a direction indicated by an arrow q, and in this way, the fixing belt 50 is driven to rotate in a direction indicated by an arrow u. The IH coil unit 52 generates the magnetic flux to the fixing belt 50 through the application of the high-frequency current based on the inverter drive circuit 68.

As shown in FIG. 4, the magnetic flux of the IH coil unit 52 is inducted to the first magnetic path 81 passing through the heating layer 50*a* of the fixing belt 50, in this way, the heating layer 50*a* generates heat. The magnetic flux of the IH coil unit 52 passing through the fixing belt 50 is inducted to the second magnetic path 82 passing through the auxiliary heating plate 69, in this way, the auxiliary heating plate 69 assists in the heating.

The auxiliary heating plate 69 assists in the heating of the fixing belt 50 across the gap G, which encourages the rapid warming up of the fixing belt 50.

As shown in FIG. 2, the IH control circuit 67 controls the inverter drive circuit 68 according to the detection results of the center thermistor 61 or the edge thermistor 62. The inverter drive circuit 68 supplies a given current for the coil 56.

Hereinafter, the operation of the fixing device 34 in the fixing operation is described.

After the temperature of the fixing belt 50 reaches the fixing temperature and the warming up is completed, if there is a printing request, the MFP 10 (refer to FIG. 1) starts the printing operation. The MFP 10 forms a toner image on the sheet P in the printer section 18 and then conveys the sheet P to the fixing device 34.

The MFP 10 passes the sheet P on which the toner image is formed through the nip 54 between the fixing belt 50 reaching the fixing temperature and the pressing roller 51. The fixing device 34 fixes the toner image on the sheet P. During the fixing process, the IH control circuit 67 controls the IH coil unit 52 to maintain the fixing belt 50 at the fixing temperature.

Through the fixing operation, the heat of the fixing belt 50 is absorbed by the sheet P. For example, in a case of passing paper continuously at a high speed, a large quantity of heat is absorbed by the sheet P, thus, there is a case in which the fixing belt 50 with low heat capacity cannot be maintained at the fixing temperature. The auxiliary heating plate 69 assists in the heating of the fixing belt 50 from the inner periphery of the fixing belt 50, in this way, the insufficiency of belt calorific value can be compensated. The assistance in the heating of the fixing belt 50 from the auxiliary heating plate 69 can maintain the temperature of the fixing belt 50 at the fixing temperature even in the case of passing paper continuously at a high speed.

Hereinafter, the operation of the fixing device 34 in a case of passing sheets P having different paper widths is described.

As shown in FIG. 2, the driving section 90 adjusts the interval Lg according to the sheets P having different paper widths under the control of the motor driving circuit 51*c*.

In a case of passing small-sized paper, the motor driving circuit 51*c* controls the cam motor 92 to move the side portions 69*b* and 69*c* of the auxiliary heating plate 69 away from the inner peripheral surface of the fixing belt 50. With the heat directly generated by the fixing belt 50 through the magnetic flux of the IH coil unit 52 and the assistance in heating from the auxiliary heating plate 69, the fixing belt 50 can achieve sufficient heat for the fixation of the sheet P. For example, in a case of passing small-sized paper to carry out the fixing operation continuously, the temperature in the paper passing area AR1 of the fixing belt 50 is decreased while the temperature in the non-paper passing area AR2 is increased. When moved away from the inner peripheral surface of the fixing belt 50, the side portions 69*b* and 69*c* can hardly assist in the heating of the non-paper passing area AR2. In this way, it is possible to prevent that the temperature of the non-paper passing area AR2 of the fixing belt 50 becomes higher than the temperature of the fixing belt 50. As a result, the heating of the fixing belt 50 is equalized.

In a case of passing large-sized paper, the motor driving circuit 51*c* controls the cam motor 92 to move the side portions 69*b* and 69*c* of the auxiliary heating plate 69 closer to the inner peripheral surface of the fixing belt 50. In this way, the auxiliary heating plate 69 can assist in the heating of the entire fixing belt 50 in a case of passing large-sized paper. As a result, the heating of the fixing belt 50 is equalized.

In accordance with the first embodiment, the auxiliary heating plate 69 does not generate heat itself through the induction current generated by the IH coil unit 52. In this case, it is possible to prevent that the belt calorific value is increased excessively compared with a case in which the auxiliary heating plate 69 is provided with a magnetic alloy layer for generating heat itself. In this way, the heating efficiency of the fixing belt 50 can be improved.

The side portions 69*b* and 69*c* of the auxiliary heating plate 69 are moved closer to or away from the fixing belt 50. In a case of passing small-sized paper, the side portions 69*b* and 69*c* are moved away from the fixing belt 50, thus, the side portions 69*b* and 69*c* can hardly assist in the heating of the non-paper passing area AR2. In a case of passing large-sized paper, the side portions 69*b* and 69*c* are moved closer to the fixing belt 50, thus, the auxiliary heating plate 69 can assist in the heating of the entire fixing belt 50. The side portions 69*b* and 69*c* are moved closer to or away from the fixing belt 50 to prevent the temperature unevenness of the fixing belt 50 between the paper passing area AR1 and the non-paper passing area AR2. In this way, the heating of the fixing belt 50 can be equalized.

The center portion 69*a* is fixed at a certain position, while the side portions 69*b* and 69*c* are moved closer to or away from the fixing belt 50. In this way, the heating of the fixing belt 50 can be equalized in a fixing method (center fixed method) in which the center portion 69*a* is fixed at a certain position.

The shield 76 supporting the auxiliary heating plate 69 is formed by a nonmagnetic material. The shield 76 can shield the magnetic flux from the IH coil unit 52 to prevent the components arranged inside the fixing belt 50 from being affected by the magnetic flux.

The driving section 90 includes the eccentric cam 91 which rotates around the axis 91*a* parallel to the belt width direction and abuts against the shield 76. With the eccentric cam 91, the constitution of the driving section 90 can be simplified.

The motor driving circuit 51*c* controls the cam motor 92 based on the detection result of the edge thermistor 62. In this way, the heating of the fixing belt 50 can be equalized before the temperature in the non-paper passing area AR2 of the fixing belt 50 is increased excessively.

Hereinafter, a fixing device according to a second embodiment is described with reference to FIG. 10. The second embodiment includes a side fixed division portion, which is different from the first embodiment including the center fixed division portion. The same components in the second embodiment as those described in the first embodiment are indicated by the same reference numerals, and the detailed description thereof is not provided.

Figure 10:
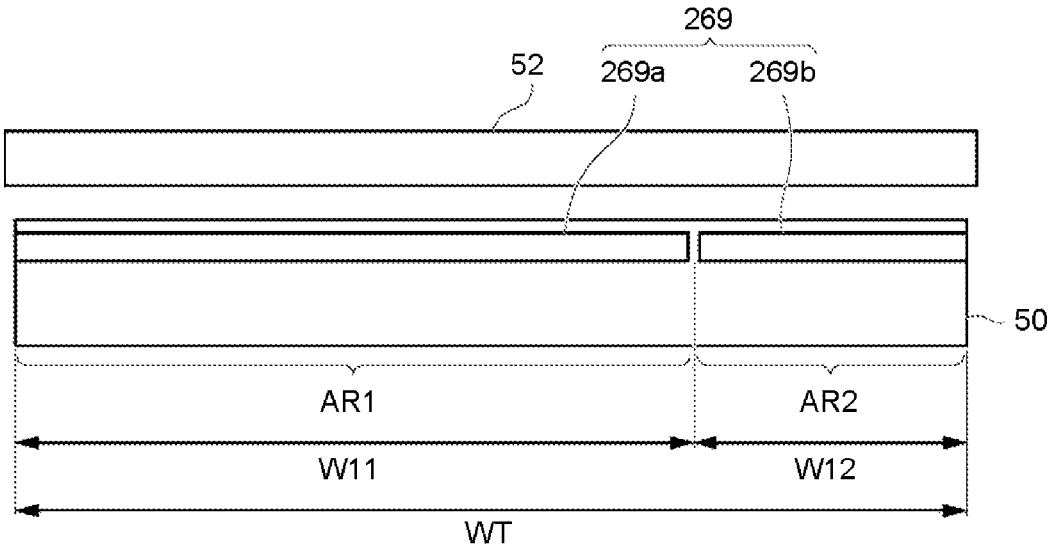
FIG. 10 is an illustration diagram illustrating the arrangement of the fixing belt, the IH coil unit and division portions of an auxiliary heating plate according to a second embodiment.

FIG. 10 is an illustration diagram illustrating the arrangement of the fixing belt 50, the IH coil unit 52 and division portions 269*a* and 269*b* of an auxiliary heating plate 269 according to the second embodiment.

As shown in FIG. 10, the auxiliary heating plate 269 includes two division portions 269*a* and 269*b* divided in the belt width direction. In the following description, within the two division portions 269*a* and 269*b*, the division portion 269*a* positioned at a first end in the belt width direction is referred to as a "first division portion". The division portion 269*b* positioned at a second end in the belt width direction is referred to as a "second division portion".

A width W11 (hereinafter referred to as a "first division width") of the first division portion 269*a* is longer than the A4R width. A width W12 of the second division portion 269*b* is shorter than the first division width W11. In addition, the first division width W11 may be equal to the A4R width.

The first division portion 269*a* is held at a certain position without being moved by the driving section 90. The driving section 90 moves the second division portion 269*b*. The driving section 90 moves the second division portion 269*b* closer to or away from the fixing belt 50.

In accordance with the second embodiment, the first division portion 269*a* is fixed at a certain position, while the second division portion 269*b* is moved closer to or away from the fixing belt 50. In this way, the heating of the fixing belt 50 can be equalized in a fixing method (side fixed method) in which the first division portion 269*a* is fixed at a certain position.

Hereinafter, a fixing device according to a third embodiment is described with reference to FIG. 11-FIG. 16. The third embodiment includes an external ferrite core and an internal ferrite core having a thickness smaller than that of the external ferrite core. The same components in the third embodiment as those described in the first embodiment are indicated by the same reference numerals, and the detailed description thereof is not provided.

Figure 11:
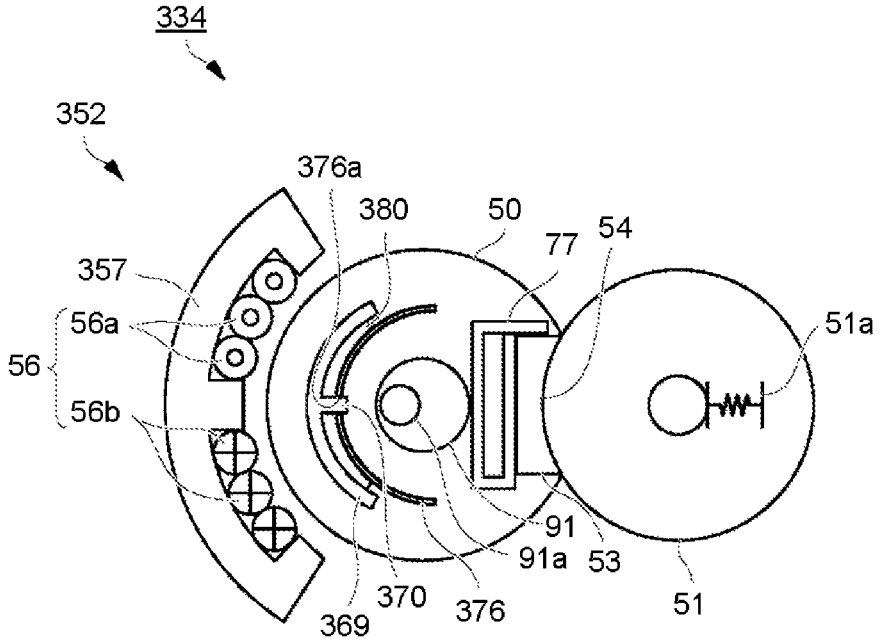
FIG. 11 is a side view illustrating a fixing device according to a third embodiment.

FIG. 11 is a side view illustrating a fixing device 334 according to the third embodiment. In addition, for the sake of the convenience of description, the thermostat 63 and the like are not shown in FIG. 11.

As shown in FIG. 11, the fixing device 334 is provided with the fixing belt 50, the pressing roller 51 and an IH coil unit 352.

The IH coil unit 352 includes the coil 56 and an external ferrite core 357. The external ferrite core 357 is arranged at the outside of the fixing belt 50. The external ferrite core 357 covers the back side of the coil 56.

An internal ferrite core 369 and a shield 376 are arranged inside the fixing belt 50. The internal ferrite core 369 is formed into an arc shape along the inner peripheral surface of the fixing belt 50 at an interval from the inner peripheral surface of the fixing belt 50.

For example, the external ferrite core 357 and the internal ferrite core 369 are formed by Ni—Zn ferrite, Mn—Ni ferrite and the like.

A protrusion 370 protruding towards the center of the fixing belt 50 is formed at the side (hereinafter referred to as "inner side") of the internal ferrite core 369 opposite to the external ferrite core 357. An inserting hole 376*a* into which the protrusion 370 of the internal ferrite core 369 is inserted is formed in the shield 376. The protrusion 370 is inserted into the inserting hole 376*a*, in this way, the internal ferrite core 369 can be positioned.

Figure 12:
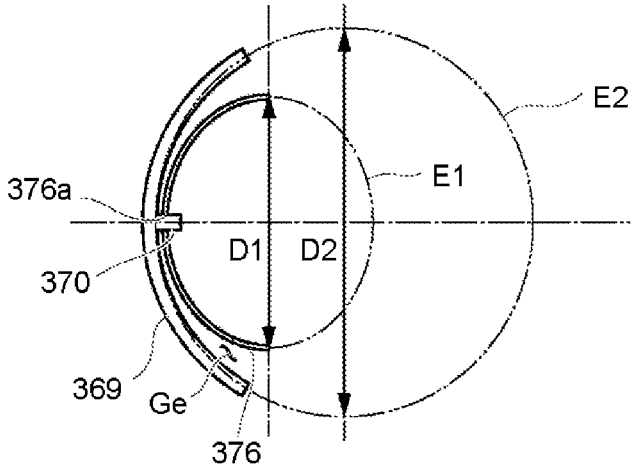
FIG. 12 is an illustration diagram illustrating the shapes of an internal ferrite core and a shield according to the third embodiment.

FIG. 12 is an illustration diagram illustrating the shapes of the internal ferrite core 369 and the shield 376 according to the third embodiment.

As shown in FIG. 12, the shield 376 is formed into an arc shape along a virtual ellipse E1 of which the length of the long axis (hereinafter referred to as a "major axis") is D1. The internal ferrite core 369 is formed into an arc shape along a virtual ellipse E2 having a major axis D2 longer than the major axis D1. As the internal ferrite core 369 has the major axis D2 longer than the major axis D1, thus, a gap Ge is generated when the internal ferrite core 369 is put on the shield 376.

For example, as shown in FIG. 11, a fixing member 380 such as silicone adhesive and the like is injected into the gap Ge. The internal ferrite core 369 is fixed on the shield 376 by the fixing member 380. With the fixing member 380 such as the silicone adhesive and the like injected into the gap Ge, the internal ferrite core 369 can be actually fixed on the shield 376 even if dimensional variation occurs in the internal ferrite core 369. Further, the assembling of the internal ferrite core 369 can be simplified and the manufacturing cost can be reduced. Further, the adhesive is used as the fixing member 380, in this way, it is possible to prevent the abnormal sound caused due to the vibration of the internal ferrite core 369 through the elasticity of the adhesive.

Figure 13:
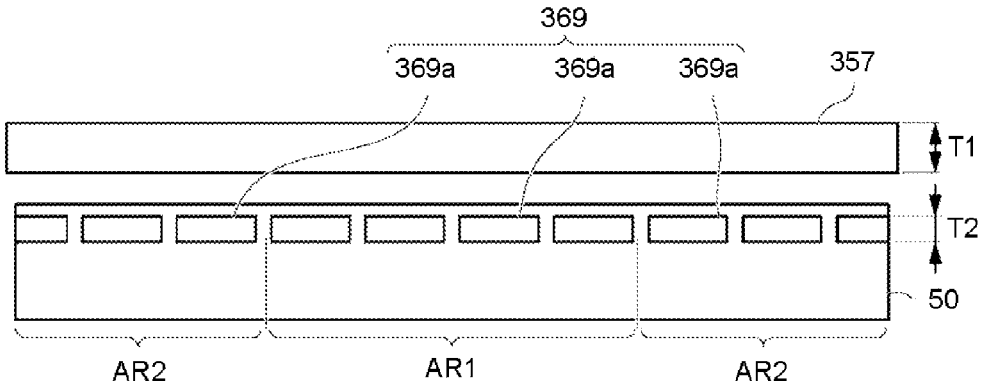
FIG. 13 is an illustration diagram illustrating the thickness of an external ferrite core and the internal ferrite core according to the third embodiment.

FIG. 13 is an illustration diagram illustrating the thickness of the external ferrite core 357 and the internal ferrite core 369 according to the third embodiment.

As shown in FIG. 13, a thickness T2 of the internal ferrite core 369 is smaller than a thickness T1 of the external ferrite core 357 in the belt width direction. For example, the thickness T2 of the internal ferrite core 369 is set to be smaller than 3 mm and the thickness T1 of the external ferrite core 357 is set to be greater than 4 mm. The internal ferrite core 369 includes a plurality of division pieces 369*a* divided in the belt width direction. The thickness T2 of each division piece 369*a* is smaller than the thickness T1 of the external ferrite core 357 in the paper passing area AR1 and the non-paper passing area AR2.

Figure 14:
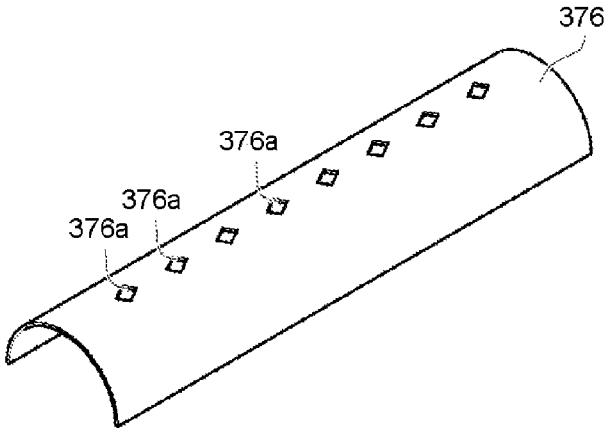
FIG. 14 is a perspective view illustrating the shield according to the third embodiment.

FIG. 14 is a perspective view illustrating the shield 376 according to the third embodiment.

As shown in FIG. 14, a plurality of inserting holes 376*a* are formed in the shield 376 in the belt width direction. Each inserting hole 376*a* is formed into a rectangular shape having a long side inclined with respect to the belt width direction.

Figure 15:
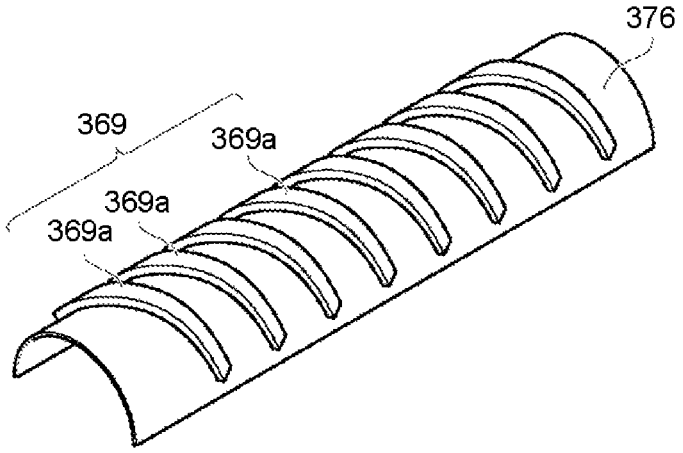
FIG. 15 is a perspective view illustrating the shield and the internal ferrite core according to the third embodiment.

FIG. 15 is a perspective view illustrating the shield 376 and the internal ferrite core 369 according to the third embodiment.

As shown in FIG. 14 and FIG. 15, each division piece 369*a* of the internal ferrite core 369 is supported in each inserting hole 376*a* of the shield 376.

Figure 16:
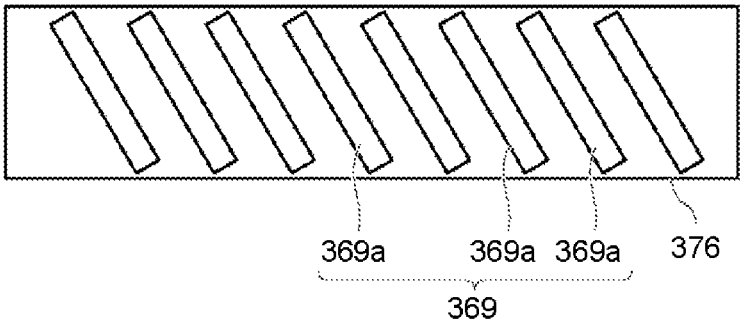
FIG. 16 is an illustration diagram illustrating the inclination of the internal ferrite core according to the third embodiment.

FIG. 16 is an illustration diagram illustrating the inclination of the internal ferrite core 369 according to the third embodiment.

As shown in FIG. 15 and FIG. 16, each division piece 369*a* of the internal ferrite core 369 is inclined with respect to the belt width direction. The inclined posture of each division piece 369*a* is the same. The arrangement interval between each division piece 369*a* in the belt width direction is the same.

In accordance with the third embodiment, the thickness T2 of the internal ferrite core 369 is smaller than the thickness T1 of the external ferrite core 357. In a case of passing small-sized paper, the internal ferrite core 369 arranged in the non-paper passing area AR2 is magnetically saturated and loses its magnetism even if the temperature of the non-paper passing area AR2 is increased excessively. In this way, the internal ferrite core 369 in the non-paper passing area A2 transmits the magnetic field of the IH coil unit 52, as a result, the internal ferrite core 369 in the non-paper passing area A2 can hardly assist in the heating, which prevents the excessive heating of the non-paper passing area AR2.

Each division piece 369*a* of the internal ferrite core 369 is inclined with respect to the belt width direction. In this way, the number of the division pieces 369*a* of the internal ferrite core 369 can be reduced, and it can be prevented that a gap is generated between two adjacent division pieces 369*a*. Since the gap between two adjacent division pieces 369*a* is prevented, the heating unevenness of the fixing belt 50 caused due to the gap can be prevented as well.

Hereinafter, a modification of the embodiment is described. In the fixing device 334 according to the embodiment described above, the thickness T2 of the internal ferrite core 369 may be set to be greater than the thickness T1 of the external ferrite core 357 as long as at least the thicknesses of the external ferrite core 357 and the internal ferrite core 369 in the non-paper passing area AR2 are different from each other.

The fixing device 334 according to the embodiment described above may has the following constitution in a case in which the internal ferrite core 369 includes a plurality of division pieces 369*a*. The thickness T2 of the division piece 369*a* arranged in the non-paper passing area AR2 within the internal ferrite core 369 may be set to be smaller than the thickness T1 of the external ferrite core 357. In this case, the thickness T2 of the division piece 369*a* arranged in the paper passing area AR1 is made different from the thickness of the division piece 369*a* arranged in the non-paper passing area AR2. In this way, the thicknesses of the division pieces 369*a* arranged in the paper passing area AR1 and the non-paper passing area AR2 are made different from each other, which can equalize the calorific value of the paper passing area AR1 and the non-paper passing area AR2.

In accordance with at least one embodiment described above, the auxiliary heating plate 69 does not generate heat itself through the induction current generated by the IH coil unit 52. In this case, it is possible to prevent that the belt calorific value is increased excessively compared with a case in which the auxiliary heating plate 69 is provided with a magnetic alloy layer for generating heat itself. In this way, the heating efficiency of the fixing belt 50 can be improved.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device comprising:

an induction current generating section configured to generate induction current;

a heating section configured to generate heat through the induction current, wherein the heating section is provided with a fixing belt including a heating layer which generates heat through the induction current;

an auxiliary heating section configured to increase the calorific value of the heating section based on the induction current as it is moved closer to the heating section, but not to generate heat itself through the induction current, wherein the auxiliary heating section includes a plurality of division portions divided in a width direction of the fixing belt;

a driving section configured to relatively move the heating section and the auxiliary heating section, wherein the driving section moves at least one of the plurality of division portions closer to or away from the fixing belt; and a center portion positioned at the center in the width direction of the fixing belt within the plurality of division portions is fixed at a certain position, wherein the driving section moves side portions positioned at two ends in the width direction of the fixing belt within the plurality of division portions closer to or away from the fixing belt.

2. The fixing device according to claim 1, further comprising:

a support member configured to support the auxiliary heating section; wherein the support member is formed by a nonmagnetic material.

3. The fixing device according to claim 1, wherein the driving section includes an eccentric cam which rotates around an axis parallel to the width direction of the fixing belt; and the eccentric cam is connected with the auxiliary heating section or the support member supporting the auxiliary heating section.

4. The fixing device according to claim 1, further comprising:

a temperature detection section configured to detect the temperature of the heating section; and a control section configured to control the driving section based on the detection result of the temperature detection section.

5. The fixing device according to claim 1, wherein the heating section is provided with a cylindrical fixing belt including a heating layer which generates heat through the induction current;

the induction current generating section includes an external ferrite core arranged at the outside of the fixing belt;

the auxiliary heating section includes an internal ferrite core arranged inside the fixing belt; and at least the thicknesses of the external ferrite core and the internal ferrite core in a non-paper passing area are different from each other.

6. A fixing device comprising:

an induction current generating section configured to generate induction current;

a heating section configured to generate heat through the induction current, wherein the heating section is provided with a fixing belt including a heating layer which generates heat through the induction current;

an auxiliary heating section configured to increase the calorific value of the heating section based on the induction current as it is moved closer to the heating section, but not to generate heat itself through the induction current, wherein the auxiliary heating section includes a plurality of division portions divided in a width direction of the fixing belt;

a driving section configured to relatively move the heating section and the auxiliary heating section, wherein the driving section moves at least one of the plurality of division portions closer to or away from the fixing belt;

a first division portion positioned at a first end in the width direction of the fixing belt within the plurality of division portions is fixed at a certain position; and the driving section moves a second division portion positioned at a second end in the width direction of the fixing belt within the plurality of division portions closer to or away from the fixing belt.

* * * * *